US010025234B2

(12) United States Patent
Sakamoto et al.

(10) Patent No.: US 10,025,234 B2
(45) Date of Patent: Jul. 17, 2018

(54) INTERMEDIATE TRANSFER BELT AND IMAGE FORMING APPARATUS

(71) Applicant: Konica Minolta, Inc., Tokyo (JP)

(72) Inventors: Sadaaki Sakamoto, Tokyo (JP); Shiori Tsugawa, Tokyo (JP); Ito Koga, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/811,202

(22) Filed: Nov. 13, 2017

(65) Prior Publication Data

US 2018/0136589 A1 May 17, 2018

(30) Foreign Application Priority Data

Nov. 17, 2016 (JP) ..... 2016-224159

(51) Int. Cl.
*G03G 15/16* (2006.01)
*G03G 21/16* (2006.01)

(52) U.S. Cl.
CPC ..... *G03G 15/162* (2013.01); *G03G 21/168* (2013.01); *G03G 2215/00059* (2013.01)

(58) Field of Classification Search
CPC ..... G03G 15/162
See application file for complete search history.

(56) References Cited

FOREIGN PATENT DOCUMENTS

| | | | |
|---|---|---|---|
| JP | 10-048966 A | | 2/1998 |
| JP | 2009015006 A | * | 1/2009 |
| JP | 2009036927 A | | 2/2009 |

* cited by examiner

*Primary Examiner* — Victor Verbitsky
(74) *Attorney, Agent, or Firm* — Lucas & Mercanti, LLP

(57) ABSTRACT

An intermediate transfer belt includes an elastic layer having a thickness of 200 to 300 μm, and a surface layer. The intermediate transfer belt has an electrostatic capacity per unit area of 13.5 to 14.5 pF/cm$^2$. The electrostatic capacity has a standard deviation of 200 pF or less.

6 Claims, 2 Drawing Sheets

INTERMEDIATE TRANSFER BELT AND IMAGE FORMING APPARATUS

CROSS REFERENCE TO RELATED APPLICATIONS

The entire disclosure of Japanese Patent Application No. 2016-224159 filed on Nov. 17, 2016, is incorporated herein by reference in its entirety.

BACKGROUND

Technological Field

The present invention relates to an intermediate transfer belt and an image forming apparatus including the intermediate transfer belt.

Description of Related Art

In an image forming apparatus, a toner image formed on a photoconductor is transferred to an intermediate transfer member, and then transferred to a recording medium such as normal paper. An endless intermediate transfer belt has been known as the intermediate transfer member. Hitherto, there has been known an intermediate transfer belt used in an electrophotographic image forming apparatus and subjected to belt design focusing attention on electrical property (for example, Japanese Patent Application Laid-Open No. 10-048966).

The intermediate transfer belt preferably has elasticity in terms of the transfer property of the toner image to the recording medium. Particularly, when a toner image is transferred to unevenness paper having a surface having an unevenness shape (for example, embossed paper), the intermediate transfer belt preferably has sufficient elasticity. Then, there has been known an intermediate transfer belt subjected to belt design focusing attention on electrical property and having an elastic layer (for example, Japanese Patent Application Laid-Open No. 2009-036927).

An intermediate transfer belt having an electrostatic capacity per unit area of 13 pF/cm$^2$ or more is disclosed in Japanese Patent Application Laid-Open No. 10-048966. An intermediate transfer belt electrostatic capacity per unit area of which is ⅕ or more relative to that of a photoconductor is disclosed in Japanese Patent Application Laid-Open No. 2009-036927.

However, if the variation in electrostatic capacity in the intermediate transfer belt is too large even when the electrostatic capacity per unit area is adjusted, image defects caused by the variation in electrostatic capacity may occur.

SUMMARY

It is a first object of the present invention to provide an intermediate transfer belt which can suppress the occurrence of image defects caused by the variation in electrostatic capacity. It is a second object of the present invention to provide an image forming apparatus which can suppress the occurrence of image defects caused by the variation in electrostatic capacity of an intermediate transfer belt, to form a high-resolution image.

In order to achieve at least one of the above-mentioned objects, an intermediate transfer belt according to one aspect of the present invention includes an elastic layer having a thickness of 200 to 300 μm, and a surface layer disposed on the elastic layer, in which the intermediate transfer belt has an electrostatic capacity per unit area of 13.5 to 14.5 pF/cm$^2$, the electrostatic capacity having a standard deviation of 200 pF or less.

In order to achieve at least one of the above-mentioned objects, an image forming apparatus according to one aspect of the present invention includes the intermediate transfer belt for transferring a toner image formed on a photoconductor to a recording medium.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1A:
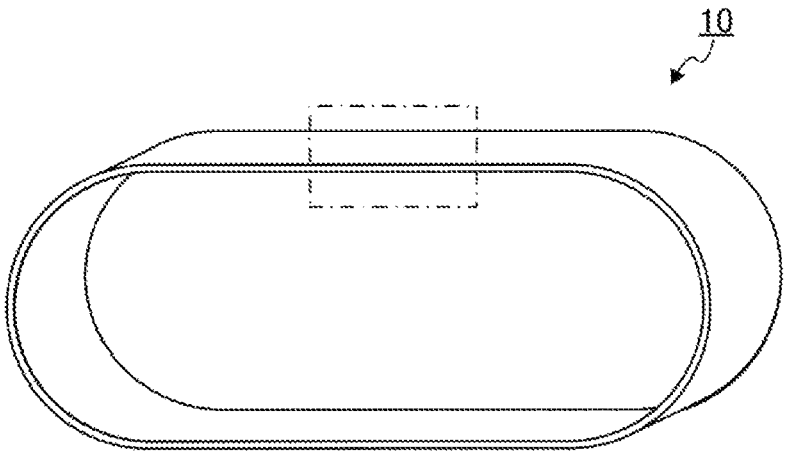
FIG. 1A schematically illustrates an intermediate transfer belt according to one embodiment of the present invention.
Figure 1B:
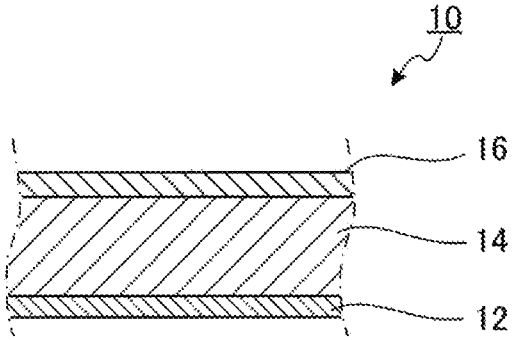
FIG. 1B schematically illustrates a layer structure of the intermediate transfer belt illustrated in FIG. 1A.

The intermediate transfer belt according to the present invention is described with reference to the drawings in detail. FIG. 1A schematically illustrates intermediate transfer belt 10 according to the present embodiment. FIG. 1B illustrates a partially enlarged cross sectional view of an area indicated by a dashed line in FIG. 1A, and schematically illustrates a layer structure of intermediate transfer belt 10.

[Configuration of Intermediate Transfer Belt]

Intermediate transfer belt 10 is an endless belt, as illustrated in FIG. 1A. Intermediate transfer belt 10 includes substrate layer 12, elastic layer 14 disposed on substrate layer 12, and surface layer 16 disposed on elastic layer 14, as illustrated in FIG. 1B.

Substrate layer 12 is an endless belt having predetermined conductivity and flexibility, and supports elastic layer 14 and surface layer 16. Substrate layer 12 is configured by, for example, a resin having flexibility. Intermediate transfer belt 10 preferably has substrate layer 12 in terms of mechanical strength and durability. From such viewpoints, the thickness of substrate layer 12 is preferably 30 to 140 μm, more preferably 50 to 130 μm. The thickness of substrate layer 12 can be determined by, for example, cutting intermediate transfer belt 10 in the stacking direction to provide cross sections, and measuring the thickness at each of the cross sections and/or calculating the average thereof.

Examples of the resin that forms substrate layer 12 include polyimide, polyamide, polyamideimide, polyether ketone, polyether ether ketone, polyvinylidene fluoride, polycarbonate, polyphenylene sulfide, polymethyl methacrylate, polystyrene, a polyacrylonitrile-styrene copolymer, polyvinyl chloride, acetate, acrylonitrile-butadiene-styrene and polyester. The resin that forms substrate layer 12 is preferably a thermosetting resin such as polyimide or polyamide imide in terms of mechanical strength and durability. The resin that forms substrate layer 12 is preferably a thermoplastic resin such as polyphenylene sulfide or polyether ether ketone in terms of a reduction in cost. Among these, the resin that forms substrate layer 12 is preferably polyphenylene sulfide in terms of durability, dimensional stability, and moldability.

Substrate layer 12 may also contain a component other than the above-mentioned resins as long as the effects of the present embodiment are achieved. Examples of the component include a conductive filler, a dispersant, and a lubricant.

The conductive filler is a component that imparts conductivity to substrate layer 12. Examples of the conductive filler include: carbon fillers such as carbon black, graphite, and carbon nanotube; metallic fillers such as aluminum, copper, and alloys thereof; and metal oxide-based fillers such as tin oxide, zinc oxide, antimony oxide, indium oxide, potassium titanate, antimony oxide-tin oxide composite oxide, and indium oxide-tin oxide composite oxide. The conductive filler is preferably a carbon filler. The conductive filler is preferably carbon black among carbon fillers. The surface of carbon black may be subjected to oxidation treatment. Such conductive fillers may be used singly or in combinations thereof.

The content of the conductive filler is, for example, 4 to 40 parts by weight, preferably 10 to 30 parts by weight based on 100 parts by weight of the resin that forms substrate layer 12. The content of the conductive filler can be appropriately adjusted depending on the type of the conductive filler, and predetermined resistance of substrate layer 12.

The dispersant enhances dispersibility of the conductive filler. The type of the dispersant can be appropriately selected depending on the resin that forms substrate layer 12, in terms of compatibility with the resin and dispersibility of the conductive filler. For example, when the resin is polyphenylene sulfide or polyether ether ketone, the dispersant is preferably an ethylene glycidyl methacrylate-acrylonitrile styrene copolymer.

The content of the dispersant is 0.1 to 10 parts by weight, preferably 0.5 to 5 parts by weight based on 100 parts by weight of the resin that forms substrate layer 12. The content of the dispersant can be appropriately adjusted depending on predetermined dispersibility of the conductive filler.

The lubricant enhances releasability of the substrate layer 12 during molding. Examples of the lubricant include: aliphatic hydrocarbons such as paraffin wax; higher fatty acids such as lauric acid, myristic acid, palmitic acid, stearic acid, behenic acid and montanic acid; and metal salts of the higher fatty acids. The lubricant can be appropriately selected depending on the resin that forms substrate layer 12. For example, when the resin that forms substrate layer 12 is polyphenylene sulfide, the lubricant is preferably calcium montanate. The lubricants may be used singly or in combinations thereof.

The content of the lubricant is, for example, 0.1 to 0.5 parts by weight, preferably 0.1 to 0.3 parts by weight based on 100 parts by weight of the resin that forms substrate layer 12.

The thickness of substrate layer 12 is preferably 50 to 250 μm in terms of mechanical strength, image quality and production cost.

(Elastic Layer)

Elastic layer 14 is a layer disposed on an outer peripheral surface of substrate layer 12 and having electrical property and elasticity. Elastic layer 14 is configured by, for example, a rubber composition having elasticity. The rubber composition preferably contains, for example, diene crosslinked rubber in terms of moldability.

The diene crosslinked rubber is a crosslinked molded body of diene rubber having a double bond in a main chain. Examples of the diene rubber include crude rubber, isoprene rubber, chloroprene rubber, styrene-butadiene rubber, butadiene rubber, and acrylonitrile-butadiene rubber. The diene rubber is preferably chloroprene rubber or acrylonitrile-butadiene rubber (NBR) in terms of hardness and durability of elastic layer 14.

An acrylonitrile amount in the above NBR can be appropriately adjusted depending on predetermined elasticity and durability. The above NBR is, for example, high-nitrile NBR having an acrylonitrile amount of 36% or more and less than 43%, moderate high-nitrile NBR having an acrylonitrile amount of 31% or more and less than 36%, intermediate-nitrile NBR having an acrylonitrile amount of 25% or more and less than 31%, or low-nitrile NBR having an acrylonitrile amount of less than 25%.

The diene crosslinked rubbers may be used singly or in combinations thereof. One diene crosslinked rubber preferably forms elastic layer 14 from the viewpoint of suppressing the variation in electrostatic capacity in intermediate transfer belt 10. From such viewpoints, when two or more diene crosslinked rubbers preferably form elastic layer 14, the two or more diene crosslinked rubbers preferably have high compatibility. When elastic layer 14 is configured by a rubber composition containing the two or more diene crosslinked rubbers, the diene crosslinked rubber is preferably, for example, acrylonitrile-butadiene rubber and chloroprene rubber.

Elastic layer 14 may further contain, if necessary, a component other than the diene crosslinked rubber. For example, it is preferable that the elastic layer 14 further contains a non-diene polymer in terms of mechanical strength and durability. It is preferable that elastic layer 14 further contains one or both of polychloroprene and polyphosphazene in terms of flame resistance of elastic layer 14. Furthermore, it is preferable that elastic layer 14 further contains one or both of a conductive agent and a metal oxide particle from the viewpoint of adjusting electrical resistance of elastic layer 14.

The non-diene polymer is a polymer that does not have a double bond in a main chain. Examples of the non-diene polymer include butyl rubber, ethylene-propylene rubber, polyurethane, polycarbonate, silicone rubber, chlorosulfonated rubber, chlorinated polyethylene, acrylic rubber, epichlorohydrin rubber, and fluorine-containing rubber. The non-diene polymer is preferably polyurethane or polycarbonate in terms of durability of elastic layer 14.

The conductive agent imparts conductivity to elastic layer 14. The conductive agent can be selected from known conductive agents which can be contained in elastic layer 14 of intermediate transfer belt 10. The conductive agents may be used singly or in combinations thereof. Examples of the type of the conductive agent include an ion conductive agent and an electron conductive agent.

Examples of the ion conductive agent include tetrabutylammonium bromide, lithium tetramethylenesulfonate, silver iodide, copper iodide, lithium perchlorate, lithium trifluoromethanesulfonate, a lithium salt of an organic boron complex, lithium bisimide ($(CF_3SO_2)_2NLi$) and lithium trismethide ($(CF_3SO_2)_3CLi$).

The ion conductive agent can be appropriately selected depending on the resin that forms elastic layer 14. More specifically, the ion conductive agent preferably has high dispersibility with respect to rubber in elastic layer 14. Thus, when elastic layer 14 is formed, the ion conductive agent is likely to be uniformly dispersed in the rubber composition that forms elastic layer 14. As a result, an increase in the variation in electrostatic capacity in intermediate transfer belt 10 can be suppressed.

From such viewpoints, for example, when the rubber composition containing the diene crosslinked rubber and the ion conductive agent forms elastic layer 14, a difference (ΔSP) between the solubility parameter (SP value) of the diene crosslinked rubber and the solubility parameter of the ion conductive agent is preferably less than 6.15 $(J/cm^3)^{1/2}$.

For example, when the rubber contained in the rubber composition is high-nitrile NBR (SP value: 10.3 $(J/cm^3)^{1/2}$), the ion conductive agent is preferably tetrabutylammonium bromide (SP value: 7.3 $(J/cm^3)^{1/2}$). When the rubber contained in the rubber composition is low-nitrile NBR (SP value: 8.7 $(J/cm^3)^{1/2}$), the ion conductive agent is preferably lithium tetramethylenesulfonate (SP value: 13.5 $(J/cm^3)^{1/2}$). Furthermore, when the rubber contained in the rubber composition is chloroprene rubber (SP value: 8.1 $(J/cm^3)^{1/2}$), the ion conductive agent is preferably tetrabutylammonium bromide (SP value: 7.3 $(J/cm^3)^{1/2}$).

The SP value may be, for example, a catalog value described in Polymer Handbook (published by Wiley-Interscience), or an estimate value that can be calculated based on the estimation method of the Hansen SP value.

The content of the ion conductive agent is preferably 5 parts by weight or more, more preferably 20 parts by weight or more based on 100 parts by weight of the rubber component that forms elastic layer 14 from the viewpoint of providing predetermined conductivity. The content of the ion conductive agent is preferably 40 parts by weight or less, more preferably 30 parts by weight or less based on 100 parts by weight of the rubber component that forms elastic layer 14 from the viewpoint of suppressing an increase in the variation in electrostatic capacity of intermediate transfer belt 10 caused by the ion conductive agent contained in elastic layer 14.

Examples of the electron conductive agent include metals such as silver, copper, aluminum, magnesium, nickel and stainless steel; and carbon compounds such as graphite, carbon black, carbon nanofiber and carbon nanotube.

The content of the electron conductive agent is preferably 10 parts by weight or more, more preferably 30 parts by weight or more based on 100 parts by weight of the rubber component that forms elastic layer 14 from the viewpoint of providing predetermined conductivity. The content of the electron conductive agent is preferably 70 parts by weight or less, more preferably 50 parts by weight or less based on 100 parts by weight of the rubber component that forms elastic layer 14 from the viewpoint of suppressing an increase in the variation in electrostatic capacity of intermediate transfer belt 10 caused by the ion conductive agent contained in elastic layer 14.

The metal oxide particle may be configured by a conductive metal oxide or an insulating metal oxide. Examples of the metal oxide that forms the metal oxide particle include aluminum oxide, aluminum hydroxide, magnesium oxide, magnesium hydroxide, zinc oxide, tin oxide, titanium oxide, silicon dioxide, potassium titanate, barium titanate, lead zirconate titanate (PZT), iron oxide, beryllium oxide, antimony oxide and calcium oxide. The metal oxide particles in elastic layer 14 may be used singly or in combinations thereof.

The metal oxide that forms the metal oxide particle can be appropriately selected from the viewpoint of further imparting a predetermined function to intermediate transfer belt 10. For example, the metal oxide is preferably aluminium hydroxide, antimony oxide, or magnesium hydroxide in terms of flame resistance. The metal oxide is preferably silica dioxide, titanium oxide, or potassium titanate from the viewpoint of adjusting hardness of elastic layer 14. The metal oxide is preferably magnesium oxide in terms of use thereof also as an acid capture agent. The metal oxide is preferably zinc oxide or tin oxide in terms of use thereof also as a crosslinking promoter when elastic layer 14 is formed. The metal oxide is preferably calcium oxide or magnesium oxide in terms of use of the metal oxide particle also as a water-absorbing agent.

The size of the metal oxide particle can be appropriately modified as long as the effects of the present embodiment are achieved. If the particle size of the metal oxide particle is too small, dispersibility may deteriorate, and handling may be made difficult. If the particle size of the metal oxide particle is too large, the surface roughness of elastic layer 14 may be excessively increased, and the variation in electrostatic capacity of intermediate transfer belt 10 may be excessively increased. From such viewpoints, the particle size of the metal oxide particle is preferably 10 nm to 100 μm, more preferably 100 nm to 10 μm. The particle size may be a representative value that defines the size of the metal oxide particle, and is, for example, the volume average particle size or the number average particle size.

The particle size of the metal oxide particle may be determined as follows, for example. An enlarged photograph at 10,000 magnification taken by a scanning electron microscope (manufactured by JEOL Ltd.) is incorporated into a scanner. From the obtained photographic image, 300 particle images excluding agglomerated particles are binarized at random using an automatic image processing/analysis system "LUZEX AP" (manufactured by Nireco Corporation; "LUZEX" is their registered trademark, Software Ver. 1.32) to calculate the horizontal Feret diameter of each particle image, and the average is calculated as the number average primary particle sizes. Here, the horizontal Feret diameter refers to the length of the side parallel to the x-axis of the circumscribed rectangle of the binarized particle image.

The metal oxide particle is preferably subjected to surface treatment using a surface treating agent in terms of the dispersibility of the metal oxide particle in elastic layer 14. The surface treating agent is, for example, a silane coupling agent. When the surface of the metal oxide particle is treated with a silane coupling agent, a component subjected to a reaction with the silane coupling agent is supported on the surface of the metal oxide particle in elastic layer 14.

Examples of the silane coupling agent include: vinyltrialkoxysilanes such as vinyltrimethoxysilane and vinyltriethoxysilane; p-styryltrialkoxysilanes such as p-styryltrimethoxysilane; 3-methacryloxypropyltrialkoxysilanes such as 3-methacryloxypropyldimethoxysilane, 3-methacryloxypropyltrimethoxysilane, 3-methacryloxypropylmethyldiethoxysilane, and 3-methacryloxypropyltriethoxysilane; and 3-acryloxytrialkoxysilanes such as 3-acryloxypropyltrimethoxysilane.

The content of the metal oxide particle in elastic layer 14 is preferably 10 parts by weight or more, more preferably 30 parts by weight or more based on 100 parts by weight of the rubber component that forms elastic layer 14 from the viewpoint of exhibiting a predetermined function. The content of the metal oxide particle in elastic layer 14 is preferably 70 parts by weight or less, more preferably 50 parts by weight or less based on 100 parts by weight of the rubber component that forms elastic layer 14 from the viewpoint of suppressing an increase in the variation in electrostatic capacity of intermediate transfer belt 10 caused by the metal oxide particle contained in elastic layer 14. The content of the metal oxide particle in elastic layer 14 can be appropriately adjusted depending on the type or the size of the metal oxide particle.

The thickness of elastic layer 14 is 200 to 300 μm. If the thickness of elastic layer 14 is too small, predetermined elasticity may not be achieved. If the thickness of elastic layer 14 is too large, the variation in a thickness of elastic layer 14 and variation in electrostatic capacity may be excessively increased, and the productivity of the intermediate transfer belt may be deteriorated. The thickness of elastic layer 14 can be determined by, for example, cutting intermediate transfer belt 10 in the stacking direction to provide cross sections, and measuring the thickness at each of the cross sections and/or calculating the average thereof. The thickness of elastic layer 14 can be appropriately adjusted depending on the variations in predetermined elasticity and electrostatic capacity.

Surface layer 16 is disposed on the outer peripheral surface of elastic layer 14. Surface layer 16 has both moderate softness capable of protecting elastic layer 14 and being deformed in accordance with deformation of elastic layer 14 and sufficient durability (such as mechanical strength and releasability) to the contact with a photoreceptor and a recording medium. Surface layer 16 is configured by, for example, a cured product provided by radical polymerization of a radical polymerizable composition containing a radical polymerizable compound.

The radical polymerizable compound is, for example, a polyfunctional radical polymerizable compound having a plurality of radical polymerizable functional groups. The polyfunctional radical polymerizable compound preferably has four or more radical polymerizable functional groups. Examples of the polyfunctional radical polymerizable compound include polyfunctional (meth)acrylate and polyfunctional urethane acrylate. Herein, a "(meth)acryloyl group" means one or both of an acryloyl group and a methacryloyl group. The radical polymerizable compounds may be used singly or in combinations thereof. The radical polymerizable compound that forms surface layer 16 can be presumed from, for example, the results of analyzing surface layer 16 according to thermal decomposition GC-MS.

Examples of polyfunctional (meth)acrylate include dipentaerythritol hexaacrylate (DPHA), ethoxylated (12) DPHA, and caprolactone-modified (6) DPHA.

Polyfunctional (meth)acrylate may be a commercialized product. Examples of the polyfunctional (meth)acrylate commercialized product include KAYARAD DPHA manufactured by Nippon Kayaku Co., Ltd. ("KAYARAD" is a registered trademark of this company, and the rest is omitted), DPEA-12, DPCA-30, DPCA-60, and DPCA-120.

Polyfunctional urethane acrylate may be a commercialized product. Example of the polyfunctional urethane acrylate commercialized product include U-6LPA, U-10HA, UA-1100H, U-15HA, and UA-33H manufactured by Shin-Nakamura Chemical Co., Ltd.

Surface layer 16 may further contain other components as long as effects of the present embodiment are achieved. Examples of the other components include a metal oxide particle and a vinyl copolymer. The metal oxide particle is preferably contained in surface layer 16 in terms of mechanical strength and durability of surface layer 16. The content of the metal oxide particle in surface layer 16 is 10 to 60 parts by volume, preferably 20 to 50 parts by volume based on 100 parts by volume of a portion of surface layer 16 other than the metal oxide particle, Example of the metal oxide that forms the metal oxide particle in surface layer 16 is the same as the metal oxide in elastic layer 14. The metal oxide particles in surface layer 16 may be used singly or in combinations thereof.

The size of the metal oxide particle can be appropriately modified as long as the effects of the present embodiment are achieved. The particle size of the metal oxide particle in surface layer 16 is preferably 1 to 100 nm. This particle diameter may be a representative value specifying the size of the metal oxide particle, and is, for example, a volume average particle diameter or a number average particle diameter. The particle size of the metal oxide particle in surface layer 16 can also be measured by, for example, the same method as that of the particle size of the metal oxide particle in elastic layer 14. The size of the metal oxide particle can be appropriately adjusted depending on the variations in predetermined hardness, abrasion resistance, durability, and electrostatic capacity of surface layer 16.

Examples of the vinyl copolymer include vinyl acetate, styrene, acrylonitrile, and siloxane-based vinyl copolymers. The siloxane-based vinyl copolymer particularly preferably includes one or more polyorganosiloxane chains A and three or more radical polymerizable double bonds, from the viewpoints of preventing filming on intermediate transfer belt 10 and maintaining a low surface free energy of surface layer 16. The weight average molecular weight of the siloxane-based vinyl copolymer is preferably 5,000 to 100,000 from the viewpoint of enhancing compatibility of the siloxane-based vinyl copolymer in a coating solution for surface layer formation, described below.

Furthermore, when the siloxane-based vinyl copolymer and the metal oxide particle in surface layer 16 are used, the metal oxide particle in surface layer 16 is preferably surface-treated by a silicone-based surface treating agent from the viewpoint of dispersing both the metal oxide particle and the siloxane structure derived from the siloxane-based vinyl copolymer in surface layer 16. The siloxane structure can be dispersed in surface layer 16, thereby allowing releasability due to the siloxane structure to be stably exhibited over a long period.

Examples of the silicone-based surface treating agent include methyl hydrogen polysiloxane and modified silicone oil. Examples of the modified silicone oil include amino-modified silicone, epoxy-modified silicone, carbinol-modified silicone, mercapto-modified silicone and carboxyl-modified silicone. The weight average molecular weight of the silicone-based surface treating agent is, for example, 300 to 20,000 from the viewpoints that a predetermined function is exhibited and handling in surface treatment is easy.

The metal oxide particle in elastic layer 14 and surface layer 16 can be produced by a known production method. Examples of the production method include a gas phase method, a chlorine method, a sulfuric acid method, a plasma method and an electrolysis method.

Surface layer 16 may further contain other component as long as predetermined characteristics (for example, cleaning property, flexibility, durability and adhesiveness) are achieved. Examples of the other component include a light stabilizer, an antistatic agent, a lubricant, a leveling agent, an antifoaming agent, an antioxidant, a fire retardant and a surface-active agent.

The thickness of surface layer 16 is preferably 2 to 10 μm in terms of predetermined flexibility and durability in surface layer 16. The thickness of surface layer 16 can be determined by, for example, cutting intermediate transfer belt 10 in the stacking direction to provide cross sections, and measuring the thickness at each of the cross sections and/or calculating the average thereof.

[Electrical Property of Intermediate Transfer Belt]

The electrostatic capacity per unit area of intermediate transfer belt 10 according to the present embodiment is 13.5 to 14.5 pF/cm$^2$. The electrostatic capacity per unit area of less than 13.5 pF/cm$^2$ makes it difficult to cause a toner on intermediate transfer belt 10 to move to the recording medium, which may cause transfer failures. The electrostatic capacity per unit area of more than 14.5 pF/cm$^2$ makes it difficult to cause intermediate transfer belt 10 to be charged, which may cause transfer failures. From such viewpoints, the electrostatic capacity per unit area is preferably 13.6 to 14.3 pF/cm$^2$. The electrostatic capacity per unit area can be adjusted by, for example, a component contained in the rubber composition that forms elastic layer 14 and its content, and the thickness of elastic layer 14.

The standard deviation of the electrostatic capacity of intermediate transfer belt 10 is 200 pF or less. The standard deviation of the electrostatic capacity represents the degree of the variation in electrostatic capacity in intermediate transfer belt 10. The standard deviation of the electrostatic capacity will be described in detail later. When the standard deviation of the electrostatic capacity is more than 200 pF, the variation in electrostatic capacity in intermediate transfer belt 10 is too large, which may not provide predetermined electrical property. From such viewpoints, the standard deviation of the electrostatic capacity is preferably 150 pF or less. The standard deviation of the electrostatic capacity is, for example, 100 pF or more. For example, as the thickness of elastic layer 14 is more uniform, the standard deviation of the electrostatic capacity is smaller. As the dispersion state of the component in elastic layer 14 is more uniform, the standard deviation of the electrostatic capacity is smaller.

The electrostatic capacity of intermediate transfer belt 10 can be determined based on, for example, an oscillation frequency and inductance measured using Coating Thickness Scanning System (TSS20 manufactured by Lasertec Corporation), and the following formula. The standard deviation of the electrostatic capacity can be determined based on, for example, measured values at 3,600 points of the electrostatic capacities measured at a total of 3,600 points placed at intervals of 1 mm in a measured area of 60 mm×60 mm. The electrostatic capacity per unit area can be determined by, for example, converting the average value of the measured values at 3,600 points into a value per unit area. For example, when the oscillation frequency measured using Coating Thickness Scanning System is 7 MHz, the electrostatic capacity per unit area can be determined to be 50 pF/cm$^2$.

[Equation 1]

$$C = \frac{1}{4\pi^2 L f^2} \tag{1}$$

In the formula (1), C represents electrostatic capacity [F]; L represents inductance [H]; and f represents an oscillation frequency [Hz].

The volume resistivity of intermediate transfer belt 10 is preferably $10^8$ to $10^{12}$ Ω·cm, more preferably $10^9$ to $10^{11}$ Ω·cm, still more preferably $10^{10}$ to $10^{11}$ Ω·cm from the viewpoints of suppressing the occurrence of transfer failures and forming a high-resolution image in an image forming apparatus including intermediate transfer belt 10 according to the present embodiment.

The volume resistivity of intermediate transfer belt 10 can be determined based on, for example, a current value when a voltage of 500 V is applied in the stacking direction of intermediate transfer belt 10 using a high resistivity meter (manufactured by Mitsubishi Chemical Analytech Co., Ltd.).

The volume resistivity of intermediate transfer belt 10 can be adjusted by, for example, the type and the content of the metal oxide particle contained in elastic layer 14, and the type and the content of the conductive agent (ion conductive agent and electron conductive agent) contained in elastic layer 14.

The surface resistivity of intermediate transfer belt 10 is preferably $10^{11}$ to $10^{13}$Ω/□, more preferably $10^{12}$ to $10^{13}$Ω/□ from the viewpoints of suppressing the occurrence of transfer failures and forming a high-resolution image in the image forming apparatus including intermediate transfer belt 10 according to the present embodiment.

The surface resistivity of intermediate transfer belt 10 can be determined based on, for example, a current value when a voltage of 100 V is applied to the outer surface of intermediate transfer belt 10 using Digital Super Megohmmeter (manufactured by Hioki E.E. Corporation).

The surface resistivity of intermediate transfer belt 10 can be adjusted by, for example, the type and the content of the metal oxide particle contained in surface layer 16.

[Method for Producing Intermediate Transfer Belt]

Next, a method for producing intermediate transfer belt 10 according to the present embodiment will be described. The method for producing intermediate transfer belt 10 according to the present embodiment includes 1) a first step of forming elastic layer 14 on substrate layer 12, and 2) a second step of forming surface layer 16 on elastic layer 14.

Substrate layer 12 can be formed by known methods. Examples of the step of forming substrate layer 12 include a step of heating a coating film of polyamic acid applied on the surface of a cylindrical substrate for imidizing the polyamic acid, to collect a resultant endless belt-shaped film as a substrate layer, as described in Japanese Patent Application Laid-Open No. 61-95361, Japanese Patent Application Laid-Open No. 64-22514, and Japanese Patent Application Laid-Open No. 3-180309.

1) First Step

The first step includes, for example, the steps of: coating substrate layer 12 with coating solution A for elastic layer formation containing a material for elastic layer formation, to form a coating film of coating solution A on substrate layer 12, and drying the coating film of coating solution A to cure the coating film, thereby forming elastic layer 14.

Specifically, first, coating solution A for elastic layer formation containing a material for elastic layer formation is prepared. For example, coating solution A can be prepared by dispersing the diene rubber in a known solvent. Example of the known solvent used for coating solution A includes toluene. Coating solution A may contain other components such as a crosslinking agent for crosslinking the diene rubber, the non-diene polymer, and the conductive agent, and the metal oxide particle. A component contained in coating solution A and its content can be appropriately selected depending on the predetermined electrostatic capacity per unit area and the standard deviation of the electrostatic capacity.

Coating solution A preferably contains a component having high dispersibility from the viewpoint of reducing the standard deviation of the electrostatic capacity. When coating solution A containing diene rubber and an ion conductive agent is prepared, for example, diene rubber and an ion conductive agent are preferably dispersed in a solvent so that a difference (ΔSP) between the solubility parameter (SP value) of the diene rubber and the solubility parameter of the ion conductive agent is less than 6.15 $(J/cm^3)^{1/2}$, to prepare coating solution A. Thus, the ion conductive agent can be uniformly dispersed easily in the coating film of coating solution A after curing (elastic layer 14), which can suppress an increase in the variation in electrostatic capacity.

A material for elastic layer formation is preferably dispersed in a solvent by conducting ultrasonic dispersion, using a solvent having high compatibility with respect to the material for elastic layer formation, or using a high-viscosity solvent from the viewpoint of uniformly dispersing the component contained in the coating film of coating solution A after curing (elastic layer 14), to suppress an increase in the variation in electrostatic capacity.

The crosslinking agent can be appropriately selected from known crosslinking agents used as a crosslinking agent for diene rubber. Examples of the crosslinking agent include peroxide, sulfur and a sulfur-containing compound.

Next, substrate layer 12 is coated with coating solution A, to form a coating film of coating solution A on substrate layer 12. The coating method of coating solution A can be appropriately selected from known coating methods depending on the composition of coating solution A. Examples of the coating method of coating solution A include a dip coating method and a spiral coating method. The coating method of coating solution A is preferably a spiral coating method from the viewpoint of uniforming the thickness of the coating film of coating solution A.

The viscosity of coating solution A is preferably 10,000 to 20,000 mPa·s from the viewpoint of uniforming the thickness of elastic layer 14. In the spiral coating method, the speed of movement (circumferential speed) of substrate layer 12 is preferably 100 to 200 mm/s. In the dip coating method, the speed of pulling up substrate layer 12 from coating solution A is preferably 1 to 5 mm/s. The speed of pulling up can be appropriately adjusted depending on the viscosity of coating solution A.

Next, elastic layer 14 can be formed by drying the coating film of coating solution A to cure the coating film. In the method for producing intermediate transfer belt 10 according to the present embodiment, the coating film of coating solution A is heated to dry the coating film, and to crosslink the diene rubber. Thus, the coating film is cured to allow elastic layer 14 to be formed.

The method for heating the coating film of coating solution A can be appropriately selected depending on the type of the diene rubber, the type of the crosslinking agent, the type of the solvent and the dry film thickness of coating solution A, and the like. Examples of the method for heating the coating film of coating solution A include thermal drying by a known heating apparatus such as a halogen heater, an infrared heater or a hot air heater.

The heating temperature of the coating film of coating solution A is preferably 170 to 180° C. The heating time of the coating film of coating solution A is preferably 6 to 10 minutes.

2) Second Step

The second step includes, for example, the steps of coating elastic layer 14 with coating solution B for surface layer formation containing a material for surface layer formation, to form a coating film of coating solution B on elastic layer 14; and radically polymerizing a radical polymerizable compound contained in coating solution B, to form surface layer 16.

Specifically, first, coating solution B for surface layer formation containing a radical polymerizable compound is prepared. Coating solution B can be prepared by dissolving a radical polymerizable compound in a known solvent. Examples of the known solvent used for coating solution B include propylene glycol monomethylether acetate. Coating solution B may contain other components such as a polymerization initiator, a surface tension adjuster, and the metal oxide particle.

Examples of the photopolymerization initiator include carbonyl compounds such as 1-hydroxycyclohexyl phenyl ketone, benzoin, benzoin methyl ether, benzoin ethyl ether, benzoin isopropyl ether, benzoin isobutyl ether, acetoin, butyroin, toluoin, benzil, benzophenone, p-methoxybenzophenone, diethoxyacetophenone, 2,2-dimethoxy-2-phenylacetophenone, methyl phenylglyoxylate, ethyl phenylglyoxylate, 4,4-bis(dimethylaminobenzophenone), 2-hydroxy-2-methyl-1-phenylpropan-1-one, and 1-(4-isopropylphenyl)-2-hydroxy-2-methylpropan-1-one; sulfur compounds such as tetramethylthiuram disulfide and tetramethylthiuram disulfide; azo compounds such as azobisisobutyronitrile and azobis-2,4-dimethyl valeronitrile; peroxide compounds such as benzoyl peroxide, di tert-butyl peroxide; and phosphineoxide compounds such as 2,4,6-trimethylbenzoyldiphenylphosphineoxide. The polymerization initiators may be used singly or in combinations thereof.

The content of the photopolymerization initiator in coating solution B is, for example, preferably 0.1 to 20 parts by weight, more preferably 1 to 10 parts by weight based on 100 parts by weight of the radical polymerizable compound.

Next, elastic layer 14 is coated with coating solution B, to form a coating film of coating solution B on elastic layer 14. The coating method of coating solution B can be appropriately selected from known coating methods depending on the composition of coating solution B. Examples of the coating method of coating solution B include a dip coating method, a spiral coating method and a spray coating method. The coating method of coating solution B is preferably a spiral coating method from the viewpoint of uniforming the thickness of the coating film of coating solution B.

The viscosity of coating solution B is preferably 1 to 5 mPa·s from the viewpoint of uniforming the thickness of surface layer 16. In the spiral coating method, the speed of movement (circumferential speed) of substrate layer 12 is preferably 100 to 1,500 mm/s. In the dip coating method, the speed of pulling up substrate layer 12 from coating solution B is preferably 10 to 15 mm/s. The speed of pulling up can be appropriately adjusted depending on the viscosity of coating solution B.

Next, surface layer 16 can be formed by radically polymerizing the radical polymerizable compound in the coating film of coating solution B. The radical polymerization reaction may be conducted by irradiating the coating film of coating solution B with actinic energy radiation, or may be conducted by heating the coating film of coating solution B. In the method for producing intermediate transfer belt 10 according to the present embodiment, the radical polymerization reaction is conducted by the irradiation of actinic energy radiation.

By irradiating the coating film of coating solution B with actinic energy radiation, the radical polymerizable functional group contained in the radical polymerizable compound in the coating film can be radically polymerized, to form surface layer 16. At this time, the coating film of coating solution B is preferably irradiated with actinic energy radiation while endless belt-shaped substrate layer 12 is moved along an endless orbital from the viewpoint of uniforming the thickness of surface layer 16. The speed of movement (circumferential speed) of substrate layer 12 is preferably 10 to 300 mm/sec from the viewpoints of preventing the variation in curing of the coating film, and optimizing the hardness after curing, the curing time, the speed of curing, and the like.

The amount of irradiation of actinic energy radiation is preferably 100 mJ/cm$^2$ or more, more preferably 120 to 200 mJ/cm$^2$, still more preferably 150 to 180 mJ/cm$^2$ from the viewpoints of preventing the variation in curing of the coating film of coating solution B, and optimizing the hardness after curing, the curing time, the speed of curing, and the like. The amount of irradiation can be measured by, for example, UIT250 (manufactured by USHIO Inc.). Irradiation of the coating film of coating solution B with actinic energy radiation can be conducted by an irradiation apparatus having an irradiation source for actinic energy radiation Examples of the actinic energy radiation include ultraviolet light, electron beam and y-ray. The actinic energy radiation is preferably ultraviolet light or electron beam, and is, for example, preferably ultraviolet light in terms of simplicity of handling. Examples of the irradiation source of ultraviolet light include a low-pressure mercury lamp, a medium-pressure mercury lamp, a high-pressure mercury lamp, an ultrahigh-pressure mercury lamp, a carbon-arc lamp, a metal halide lamp, a xenon lamp, an ArF excimer laser, a KrF excimer laser, an excimer lamp, and an apparatus that generates synchrotron radiation. The ultraviolet light is, for example, ultraviolet light having a wavelength of 400 nm or less.

Examples of the irradiation source of the electron beam include Cockcroft-Walton type, Van de Graff type, resonant transformer type, insulated core transformer type, linear type, dynamitron type, and radio-frequency type electron beam accelerators. Examples of the electron beam include electron beam having an energy of 50 to 1,000 keV, preferably 100 to 300 keV.

The irradiation time of the actinic energy radiation is appropriately determined in terms of curing efficiency of the coating film of coating solution B, work efficiency, and the like. The irradiation time is preferably 0.5 seconds to 5 minutes, more preferably 3 seconds to 2 minutes.

The concentration of oxygen in the atmosphere in the irradiation with the actinic energy radiation is preferably 5 vol % or less, more preferably 1 vol % or less from the viewpoint of preventing oxidation of surface layer 16 formed. The oxygen concentration is adjusted by feeding of other gas such as nitrogen gas into the atmosphere. The oxygen concentration can be measured by an oxygen concentration meter OX100 (manufactured by Yokogawa Electric Company) for management of atmosphere gas.

The method for producing intermediate transfer belt 10 may include other steps if necessary. Examples of the other steps include a halogenation treatment step of elastic layer 14. By the halogenation treatment, a halogenation-treated part can be disposed on the surface of elastic layer 14. By forming surface layer 16 configured by the cured film of the radical polymerizable composition on elastic layer 14 containing the halogenation-treated part, surface layer 16 can be made thicker than surface layer 16 formed on elastic layer 14 having no halogenation-treated part; the surface hardness of surface layer 16 can be further increased; and the adhesive strength of surface layer 16 with respect to elastic layer 14 can be increased.

The halogenation treatment step can be conducted by bring a halogenating agent into contact with the surface of elastic layer 14. When the halogenating agent is brought into contact with the surface of elastic layer 14, a halogen atom is bonded to a carbon atom in the surface of elastic layer 14. The bond of the halogen atom to the carbon atom may be conducted by any of an addition reaction and a substitution reaction, or may be conducted by both the reactions.

The halogenating agent is, for example, gas or liquid. Examples of the halogenating agent include: halogen gas, hypohalous acid, and salts thereof: and mono-, di-, or tri-halogen isocyanuric acid. More specifically, examples of the halogenating agent include chlorine gas, sodium hypochlorite, and trichloroisocyanuric acid. The halogenating agent is used as it is in the halogenation treatment, or used in a state where it is diluted with inactive gas or a solvent.

Examples of the other steps include a drying step of drying the coating film of coating solution B before radical polymerization. It is preferable that the coating film of coating solution B is previously dried in terms of efficiently advancing a radical reaction. The method for drying the coating film of coating solution B can be appropriately selected depending on the type of a solvent and the dry film thickness of coating solution B, and the like. Examples of the method for drying the coating film of coating solution B include thermal drying by a known heating apparatus such as a halogen heater, an infrared heater or a hot air heater.

By the production method, intermediate transfer belt 10 according to the present embodiment can be produced. Intermediate transfer belt 10 includes elastic layer 14 having a thickness of 200 to 300 μm and surface layer 16 disposed on the elastic layer, and has an electrostatic capacity per unit area of 13.5 to 14.5 pF/cm$^2$. The electrostatic capacity has a standard deviation of 200 pF or less. Thus, the standard deviation of the electrostatic capacity is 200 pF or less, and the variation in electrostatic capacity in intermediate transfer belt 10 is small. Therefore, intermediate transfer belt 10 includes elastic layer 14 having a thickness of 200 to 300 However, when an electric charge moves along the thickness direction of intermediate transfer belt 10, the movement of the electric charge in the plane direction of intermediate transfer belt 10 can be suppressed. As a result, the distribution of the electric charge in the surface of intermediate transfer belt 10 is uniformed.

Intermediate transfer belt 10 has a volume resistivity of $10^8$ to $10^{12}$ Ω·cm and a surface resistivity of $10^{11}$ to $10^{13}$Ω/□, which can further suppress the movement of the electric charge in the plane direction of intermediate transfer belt 10.

A conductive agent having high dispersibility in the rubber composition that forms elastic layer 14 is used for the conductive agent that can be contained in elastic layer 14. This can suppress an increase in the variation in electrostatic capacity of intermediate transfer belt 10 caused by the conductive agent contained in elastic layer 14. For example, when elastic layer 14 is configured by a rubber composition containing diene crosslinked rubber and an ion conductive agent, the diene crosslinked rubber and the ion conductive agent are contained in elastic layer 14 so that a difference ΔSP between the solubility parameter SP of the diene crosslinked rubber and the solubility parameter SP of the ion conductive agent is less than 6.15 $(J/cm^3)^{1/2}$. Thus, when the conductive agent having high dispersibility is contained in elastic layer 14, the conductive agent is uniformly dispersed in elastic layer 14, which can provide a uniform conductive path in elastic layer 14. As a result, predetermined electrical property can be achieved while the increase in the variation in electrostatic capacity in intermediate transfer belt 10 is suppressed.

Elastic layer 14 of intermediate transfer belt 10 is configured by the rubber composition containing the diene crosslinked rubber and the non-diene polymer. When intermediate transfer belt 10 is mounted on the image forming apparatus, the diene crosslinked rubber may be generally deteriorated by ozone or stress due to tension that occurs in the image forming apparatus. However, when elastic layer 14 is configured by the rubber composition containing the non-diene polymer and the diene crosslinked rubber, the mechanical strength and the durability of elastic layer 14 are enhanced.

As described above, intermediate transfer belt 10 according to the present embodiment can achieve excellent electrical property (charge transportability) due to small variation in electrostatic capacity. Therefore, intermediate transfer belt 10 is suitably used as an intermediate transfer belt in an electrophotographic image forming apparatus such as a copier, a printer, and a facsimile machine.

[Image Forming Apparatus]

An image forming apparatus according to the present embodiment includes an intermediate transfer belt that transfers a toner image formed on a photoconductor to a recording medium. Examples of the recording medium here include normal paper including thin paper and heavy paper, print sheets including art paper and coated paper, Japanese paper, a card sheet, a plastic film for OHP, a cloth, and unevenness paper including embossed paper.

The image forming apparatus according to the present embodiment is formed in the same manner as in a known image forming apparatus including an intermediate transfer belt, except that intermediate transfer belt 10 according to the present embodiment is adopted. The image forming apparatus according to the present embodiment includes, for example, a photoconductor, a charging device that charges the photoconductor, an exposing device that irradiates the photoconductor charged, with light, to form an electrostatic latent image, a developing device that feeds toner to the photoconductor on which the electrostatic latent image is formed, to form a toner image corresponding to the electrostatic latent image, a transfer device including an intermediate transfer belt that transfers the toner image formed corresponding to the electrostatic latent image, to a recording medium, a fixing device that fixes the toner image to the recording medium, and a cleaning device that removes an attachment on the intermediate transfer belt. The "toner image" refers to toner collected in the form of an image.

Figure 2:
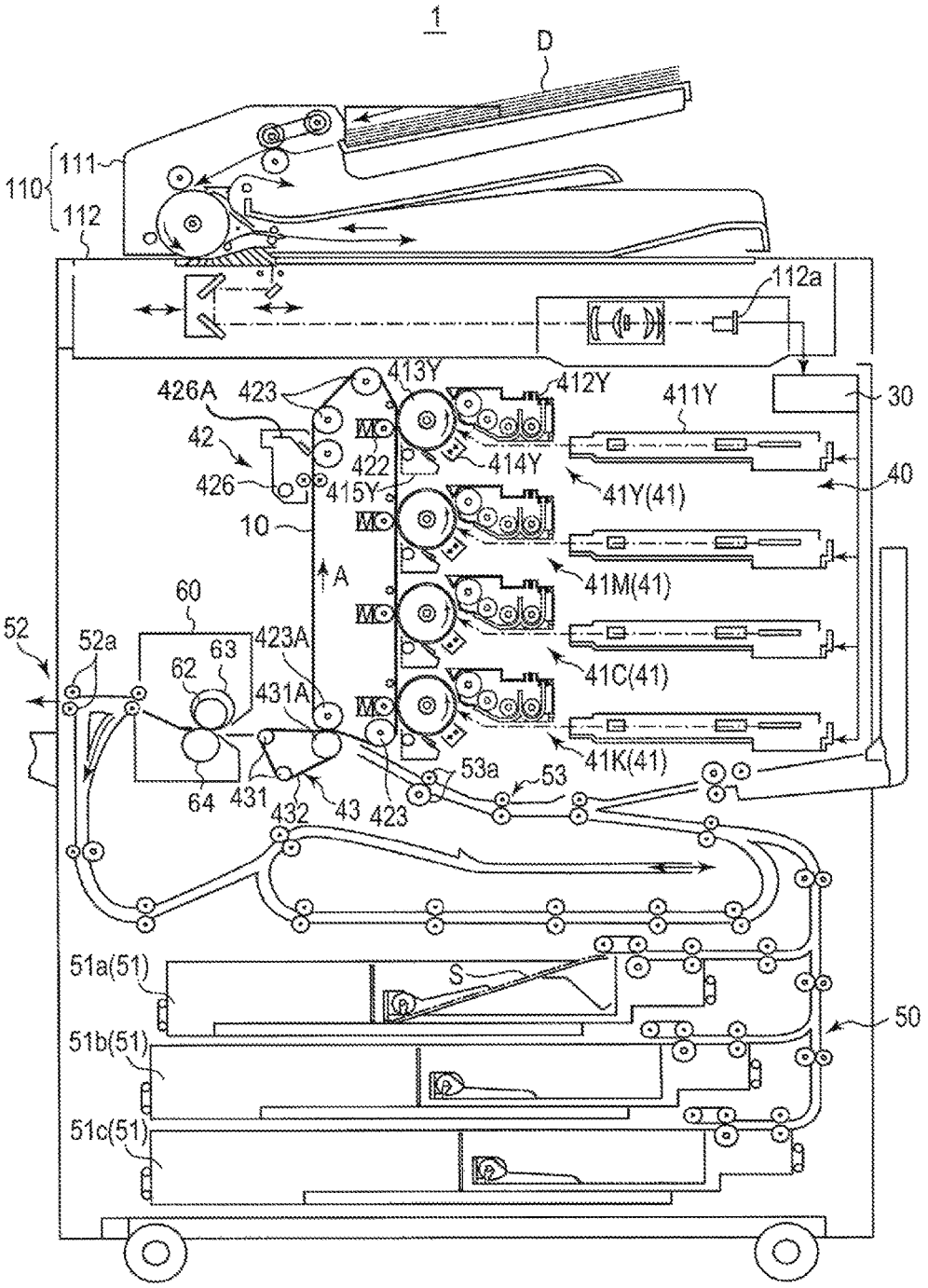
FIG. 2 schematically illustrates one example of the configuration of an image forming apparatus according to one embodiment of the present invention.

FIG. 2 schematically illustrates one example of the configuration of an image forming apparatus according to one embodiment of the present invention. As illustrated in FIG. 2, image forming apparatus 1 includes image reading section 110, image processing section 30, image forming section 40, sheet conveying section 50 and fixing device 60.

Image forming section 40 includes image forming units 41Y, 41M, 41C and 41K that form an image with toners of respective colors Y (yellow), M (magenta), C (cyan) and K (black). All these units have the same configuration except for toner to be accommodated, and therefore respective symbols representing the colors may be omitted hereinafter. Image forming section 40 further includes intermediate transfer unit 42 and secondary transfer unit 43. Such units correspond to the transfer device.

Image forming unit 41 includes exposing device 411, developing device 412, photoconductor drum 413, charging device 414 and drum cleaning device 415. Photoconductor drum 413 is, for example, a negative charge type organic photoconductor. The surface of photoconductor drum 413 has photoconductivity. Photoconductor drum 413 corresponds to the photoconductor. Charging device 414 is, for example, a corona charging device. Charging device 414 may be a contact charging device in which charging is made by bringing a contact charging member such as a charging roller, a charging brush or a charging blade into contact with photoconductor drum 413. Exposing device 411 is configured by, for example, a semiconductor laser. Developing device 412 is, for example, a developing device of a two-component development system.

Intermediate transfer unit 42 includes intermediate transfer belt 10 described above, primary transfer roller 422 that allows intermediate transfer belt 10 to be in pressure contact with photoconductor drum 413, a plurality of support rollers 423 including backup roller 423A, and belt cleaning device 426 including cleaning member 426A. Intermediate transfer belt 10 is laid on a plurality of support rollers 423 in a tensioned state so as to have a loop shape. A driving roller as at least one of a plurality of support rollers 423 is rotated to thereby allow intermediate transfer belt 10 to be travelled in the direction of arrow A at a constant speed.

Secondary transfer unit 43 includes endless secondary transfer belt 432, and a plurality of support rollers 431 including secondary transfer roller 431A. Secondary transfer belt 432 is laid on secondary transfer roller 431A and support rollers 431 in a tensioned state so as to have a loop shape.

Fixing device 60 includes fixing roller 62, endless heat generation belt 63 that covers the outer peripheral surface of fixing roller 62 and that heats and melts toner forming a toner image on sheet S, and pressure roller 64 that presses sheet S towards fixing roller 62 and heat generation belt 63. Sheet S corresponds to the recording medium.

Image reading section 110 includes sheet feeder 111 and scanner 112. Sheet conveying section 50 includes sheet feed section 51, sheet ejection section 52, and conveyance path section 53. Three sheet feed tray units 51*a* to 51*c* that form sheet feed section 51 accommodate sheets S (standard sheet, special sheet) identified based on the basis weight, the size, and the like with respect to each type set in advance. Conveyance path section 53 includes a plurality of conveyance roller pairs such as resist roller pair 53*a*.

Hereinafter, formation of an image by image forming apparatus 1 is described.

Scanner 112 optically scans document D on contact glass and reads it. Light reflected from document D is read by CCD sensor 112*a*, and formed into input image data. The input image data is subjected to predetermined image processing in image processing section 30, and transmitted to exposing device 411.

Photoconductor drum 413 is rotated at a constant circumferential speed. Charging device 414 evenly charges negatively the surface of photoconductor drum 413. Exposing device 411 irradiates photoconductor drum 413 with laser light according to the input image data of each color component. Thus, an electrostatic latent image is formed on the surface of photoconductor drum 413. Developing device 412 causes toner to be attached to the surface of photoconductor drum 413, thereby visualizing the electrostatic latent image. Thus, a toner image corresponding to the electrostatic latent image is formed on the surface of photoconductor drum 413.

The toner image on the surface of photoconductor drum 413 is transferred to intermediate transfer belt 10 by intermediate transfer unit 42. The transfer residual toner remaining on the surface of photoconductor drum 413 after transfer is removed by drum cleaning device 415 having a drum cleaning blade to be in sliding contact with the surface of photoconductor drum 413.

Intermediate transfer belt 10 is in pressure contact with photoconductor drum 413 by primary transfer roller 422, thereby forming a primary transfer nip by photoconductor drum 413 and intermediate transfer belt 10 with respect to each photoconductor drum. The toner image of each color is sequentially stacked on and transferred to intermediate transfer belt 10 in the primary transfer nip.

On the other hand, secondary transfer roller 431A is in pressure contact with backup roller 423A with intermediate transfer belt 10 and secondary transfer belt 432 interposed. Thus, a secondary transfer nip is formed by intermediate transfer belt 10 and secondary transfer belt 432. Sheet S passes through the secondary transfer nip. Sheet S is conveyed by sheet conveying section 50 to the secondary transfer nip. The inclination of sheet S is corrected and the timing of conveyance thereof is adjusted by a resist roller section where resist roller pair 53*a* is disposed.

Sheet S is conveyed to the secondary transfer nip, and thus transfer bias is applied to secondary transfer roller 431A. Such application of transfer bias allows the toner image supported on intermediate transfer belt 10 to be transferred to sheet S. Sheet S to which the toner image is transferred is conveyed by secondary transfer belt 432 towards fixing device 60.

Fixing device 60 allows a fixation nip to be formed by heat generation belt 63 and pressure roller 64, and heats and pressurizes sheet S conveyed, in the fixation nip section. Thus, the toner image is fixed to sheet S. Sheet S to which the toner image is fixed is ejected out of the apparatus by sheet ejection section 52 provided with sheet ejection roller 52*a*.

Belt cleaning device 426 includes cleaning member 426A having elasticity. Cleaning member 426A abuts with the surface of intermediate transfer belt 10, to remove an attachment on intermediate transfer belt 10. In the present embodiment, cleaning member 426A is a cleaning blade. Cleaning member 426A is in sliding contact with the surface of intermediate transfer belt 10, to remove the transfer residual toner remaining on the surface of intermediate transfer belt 10 after secondary transfer.

Intermediate transfer belt 10 is in pressure contact with photoconductor drum 413, thereby allowing surface layer 16 of intermediate transfer belt 10 to adhere to the surface of photoconductor drum 413. Thus, intermediate transfer belt 10 adheres to photoconductor drum 413. Even if intermediate transfer belt 10 is in pressure contact with sheet S pressed by backup roller 423A, the surface of intermediate transfer belt 10 again adheres to sheet S. Thus, intermediate transfer belt 10 is excellent in contact ability with photoconductor drum 413 and sheet S.

As described above, intermediate transfer belt 10 according to the present embodiment includes: elastic layer 14 having a thickness of 200 to 300 μm; and surface layer 16 disposed on the elastic layer, in which intermediate transfer belt 10 has an electrostatic capacity per unit area of 13.5 to 14.5 $pF/cm^2$, the electrostatic capacity having a standard deviation of 200 pF or less. When the electrostatic capacity per unit area of intermediate transfer belt 10 is 13.5 to 14.5 $pF/cm^2$, the transfer failures of a toner image are suppressed in image forming apparatus 1, which can provide a high-resolution image. As described above, the variation in electrostatic capacity in intermediate transfer belt 10 is small, whereby the movement of an electric charge in the plane direction of intermediate transfer belt 10 is suppressed when the electric charge moves along the thickness direction of intermediate transfer belt 10. Therefore, the electric charge can be uniformly distributed on the surface of intermediate transfer belt 10.

When the electric charge is apt to move in the plane direction of intermediate transfer belt 10, for example, the recording medium is unevenness paper having an unevenness surface, the electric charge is apt to be concentrated to a convex part of the recording medium in the case where the electric charge moves in intermediate transfer belt 10. Therefore, discharge may occur between intermediate transfer belt 10 and the convex part of the recording medium. As a result, the unevenness in image density (hereinafter, also referred to as "convex part roughness") of a toner caused by the discharge is apt to occur in the formed image. Furthermore, resistances of a black toner and a recording medium are decreased under a high temperature-high humidity (for example, 40° C., 80 RH %) environment, whereby the discharge is further apt to occur. However, in intermediate transfer belt 10 according to the present embodiment, the variation in electrostatic capacity is small, and the movement of the electric charge in the plane direction of intermediate transfer belt 10 is suppressed, whereby the concentration of the electric charge to the convex part of the recording medium is suppressed. Therefore, in image forming apparatus 1 according to the present embodiment, the occurrence of the convex part roughness can be suppressed.

In image forming apparatus 1 including intermediate transfer belt 10, the occurrence of image defects caused by the convex part roughness (discharge noise) that may occur due to the variation in electrostatic capacity in intermediate transfer belt 10 is suppressed, which can provide a high-resolution image.

As is clear from the above description, the endless intermediate transfer belt according to the present embodiment includes: an elastic layer having a thickness of 200 to 300 μm; and a surface layer disposed on the elastic layer, in which the intermediate transfer belt has an electrostatic capacity per unit area of 13.5 to 14.5 $pF/cm^2$, the electrostatic capacity having a standard deviation of 200 pF or less. Therefore, the variation in electrostatic capacity in the intermediate transfer belt according to the present embodiment is small.

The image forming apparatus according to the present embodiment includes the intermediate transfer belt according to the present embodiment. Therefore, in the image forming apparatus, the transfer failures of a toner image are suppressed, and the occurrence of image defects caused by the variation in electrostatic capacity in the intermediate transfer belt is suppressed.

The intermediate transfer belt having a volume resistivity of $1\times10^8$ to $1\times10^{12}$ Ω·cm and a surface resistivity of $1\times10^{11}$ to $1\times10^{13}$ Ω/□ is more effective from the viewpoint of reducing the variation in electrostatic capacity in the intermediate transfer belt to form a high-resolution image.

The elastic layer configured by a rubber composition containing diene crosslinked rubber and a non-diene polymer is more effective from the viewpoint of providing mechanical strength and durability of the elastic layer.

When the elastic layer is configured by a rubber composition containing diene crosslinked rubber and an ion conductive agent, a difference between the solubility parameter of the diene crosslinked rubber and the solubility parameter of the ion conductive agent being less than 6.15 $(J/cm^3)^{1/2}$ is more effective from the viewpoint of achieving predetermined electrical property while suppressing the variation in electrostatic capacity in the intermediate transfer belt.

The surface layer having a thickness of 10 μm or less is more effective in terms of flexibility and durability.

EXAMPLES

Hereinafter, the present invention is described with reference to Examples in more detail. The present invention is not limited to the following Examples.

[Production of Intermediate Transfer Belt 1]

(Formation of Substrate Layer)

Carbon black (conductive agent, SPECIAL BLACK 4; manufactured by Degussa AG) and polyamide imide varnish (HR-16NN; Toyobo Co., Ltd.) were mixed using a mixer such that the content of the carbon black was 19 parts by weight relative to 100 parts by weight of a resin component of the polyamide imide varnish, to prepare a coating solution for substrate layer formation.

Next, in a state where a cylindrical stainless mold having an outer diameter of 300 mm and a length of 550 mm was rotated at 50 rpm in a peripheral direction, the outer peripheral surface of the mold was coated with the coating solution for substrate layer formation while a dispense nozzle was moved along the axis direction of the mold. Thus, a coating film of the coating solution for substrate layer formation was formed on the outer peripheral surface of the mold.

Next, the mold was rotated at 50 rpm in the peripheral direction, while being heated at 100° C. for 1 hour using a far-infrared drying apparatus, thereby volatilizing most of a solvent. Lastly, the coating film was heated at 250° C. for 1 hour in a heating furnace, to form an endless belt-shaped substrate layer having a thickness of 65 μm. Hereinafter, the substrate layer of the endless belt-shaped substrate layer is also referred to as a "substrate" of an intermediate transfer belt.

(Formation of Elastic Layer)

The following components in the following amounts were dissolved and dispersed in toluene such that the solid content concentration was 20 mass % to prepare a coating solution for elastic layer formation.

| | |
|---|---|
| Acrylonitrile-butadiene rubber 1 | 100 parts by weight |
| Chloroprene rubber | 10 parts by weight |
| Thermal carbon | 30 parts by weight |
| Ion conductive agent 1 (tetrabutylammonium bromide) | 20 parts by weight |
| Aluminium hydroxide particle | 30 parts by weight |
| Magnesium oxide particle | 5 parts by weight |
| Zinc oxide particle | 10 parts by weight |
| Titanium oxide particle | 10 parts by weight |
| Silica particle | 15 parts by weight |

Nipol1041 (acrylonitrile amount: 40.5%, manufactured by Nippon Zeon Co., Ltd., "Nipol" is a registered trademark of this company) was used as acrylonitrile-butadiene rubber 1; DCR-66 (manufactured by Denka Company Limited) was used as chloroprene rubber; Asahi #60 (manufactured by Asahi Carbon Co., Ltd.) was used as thermal carbon (conductive agent); and tetrabutylammonium bromide (manufactured by Tokyo Kasei Kogyo Co., Ltd.) was used as ion conductive agent 1. The SP value (estimate value) of acrylonitrile-butadiene rubber 1 is 10.3, and the SP value (estimate value) of ion conductive agent 1 (tetrabutylammonium bromide) is 7.3.

B-316 (manufactured by Tomoe Engineering Co., Ltd.) was used as an aluminium hydroxide ($AlOH_3$) particle; KYOWAMAG 30 (manufactured by Kyowa Chemical Industry Co., Ltd., "KYOWAMAG" is a registered trademark of this company) was used as a magnesium oxide (MgO) particle; active zinc flower (manufactured by Hakusuitech Co., Ltd.) was used as a zinc oxide (ZnO) particle; SA-1 (manufactured by Sakai Chemical Industry Co., Ltd.) was used as a titanium oxide ($TiO_2$) particle; and REOLOSIL (manufactured by Tokuyama Corporation, "REOLOSIL" is a registered trademark of this company) was used as a silica ($SiO_2$) particle.

Next, according to a method similar to the method for coating the outer peripheral surface of the mold with the coating solution for substrate layer formation, the substrate layer was coated with the coating solution for elastic layer formation to form a coating film of the coating solution for elastic layer formation on the substrate layer. Next, in a state where the substrate was rotated at 50 rpm in a peripheral direction, the substrate was heated at 50° C. for 1 hour using a far-infrared drying apparatus, thereby volatilizing most of a solvent. Lastly, the substrate was heated at 170° C. for 20 minutes in a hot-air drying furnace, whereby the acrylonitrile-butadiene rubber and the chloroprene rubber were crosslinked to form an elastic layer having a thickness of 300 μm.

(Formation of Surface Layer)

The following components in the following amounts were dissolved and dispersed in propylene glycol monomethyl ether acetate such that the solid content concentration was 10 mass %, to prepare a dispersion liquid. Then, 1 mass % of a surface tension regulator (Silface SAG008; manufactured by Nissin Chemical Industry Co., Ltd., "Silface" is a registered trademark of this company) relative to the total amount of the dispersion liquid was further added to the dispersion liquid, to prepare a coating solution for surface layer formation.

| | |
|---|---|
| Polyfunctional acrylate | 50 parts by weight |
| Polyfunctional urethane acrylate | 50 parts by weight |
| Polymerization initiator | 5 parts by weight |

KAYARAD DPCA120 (manufactured by Nippon Kayaku Co., Ltd., "KAYARAD" is a registered trademark of this Company) was used as polyfunctional acrylate; UA-1100H (manufactured by Shin-Nakamura Chemical Co., Ltd.) was used as polyfunctional urethane acrylate; and 1-hydroxycyclohexyl-phenyl-ketone (IRGACURE184; manufactured by BASF Japan Ltd., "IRGACURE" being a registered trademark of this Company) was used as the polymerization initiator.

Next, in a state where the substrate where the coating film of the coating solution for surface layer formation was formed on the outer peripheral surface was rotated at 20 rpm in the peripheral direction, the outer peripheral surface of the elastic layer was coated with the coating solution for surface layer formation under the following spray coating conditions such that the dry film thickness was 2 μm using a spray apparatus (manufactured by YD mechatro solutions Inc.), to form a coating film of the coating solution for surface layer formation on the elastic layer.

(Spray Coating Conditions)

Nozzle scanning speed: 1 to 10 mm/sec

Distance from nozzle outlet to the surface of coating film: 100 to 150 mm

Number of nozzle: 1

Coating solution supply amount: 1 to 5 mL/min

Oxygen flow rate: 2 to 6 L/min

Next, the coating film of the coating solution for surface layer formation was irradiated with ultraviolet light as actinic radiation in the following irradiation conditions, thereby curing the coating film to form a surface layer, thereby producing intermediate transfer belt 1. Herein, such irradiation of the coating film with ultraviolet light was performed while a light source was secured and the substrate where the coating film of the coating solution for surface layer formation was formed on the outer peripheral surface was rotated at a circumferential speed of 60 mm/sec.

(Irradiation Conditions)

Type of light source: High-pressure mercury lamp (H04-L41: Eye Graphics Co., Ltd.)

Distance from irradiation hole to the surface of coating film: 100 mm

Amount of irradiation light: 1 J/cm$^2$

Irradiation time (time during which the substrate was rotated): 240 seconds

[Production of Intermediate Transfer Belts 2 to 11 and C1 to C5]

As illustrated in Table 1, intermediate transfer belts 2 to 11, and C1 to C5 were produced in the same manner as in intermediate transfer belt 1 except that the type of acrylonitrile-butadiene rubber in the elastic layer, the type and the content of the ion conductive agent, and the thickness of the elastic layer were changed.

In intermediate transfer belts 2 to 11 and C1 to C5, the elastic layer has a thickness of 300 μm, i.e., the same thickness as that of transfer belt 1, a thickness of 200 μm, a thickness of 150 μm, or a thickness of 400 μm. Intermediate transfer belts 2 to 11 and C1 to C5 were produced in the same procedure as that in the production of the elastic layer of intermediate transfer belt 1 except that the amount of the coating solution for elastic layer formation in the elastic layer having a thickness of 200 μm was set to ⅔ of that when the elastic layer having a thickness of 300 μm was produced; the amount of the coating solution for elastic layer formation in the elastic layer having a thickness of 150 μm was set to ½ of that when the elastic layer having a thickness of 300 μm was produced; or the amount of the coating solution for elastic layer formation in the elastic layer having a thickness of 400 μm was set to ¾ of that when the elastic layer having a thickness of 300 μm was produced.

In intermediate transfer belts 2 to 11 and C1 to C5, the electrostatic capacity per unit area was 13.0, 13.5, 14.0, 14.5 or 15.5 pF/cm$^2$. The electrostatic capacity per unit area was controlled by changing the amount of the ion conductive agent to be added to the coating solution for elastic layer formation, or changing the thickness of the elastic layer, as illustrated in Table 1 described below.

Furthermore, in intermediate transfer belts 2 to 11 and C1 to C5, the standard deviation of electrostatic capacity is 200 pF, i.e., equal to that of intermediate transfer belt 1, 150 pF, 220 pF or 250 pF. Here, the uniformity of the dispersion state of the component contained in the elastic layer is changed by changing a stirring time when the coating solution for elastic layer formation is prepared, thereby providing the deviation. Specifically, in the intermediate transfer belt including the elastic layer produced from the coating solution stirred for 2 hours when the coating solution for elastic layer formation was prepared, the standard deviation of electrostatic capacity was 200 pF. In the intermediate transfer belt including the elastic layer produced from the coating solution stirred for 3 hours, the standard deviation of electrostatic capacity was 150 pF. In the intermediate transfer belt including the elastic layer produced from the coating solution stirred for 1 hour, the standard deviation of electrostatic capacity was 250 pF. In the intermediate transfer belt including the elastic layer produced from the coating solution stirred for 1.5 hour, the standard deviation of electrostatic capacity was 220 pF.

Nipol 1043 (acrylonitrile amount: 29%, manufactured by Nippon Zeon Co., Ltd., "Nipol" is a registered trademark of this company) was used as acrylonitrile-butadiene rubber 2, and Nipol DN401 (acrylonitrile amount: 18%, manufactured by Nippon Zeon Co., Ltd.) was further used as acrylonitrile-butadiene rubber 3. Potassium trifluoromethanesulfonate potassium (potassium triflate, manufactured by Mitsubishi Materials Electronic Chemicals Co., Ltd.) was further used as ion conductive agent 2.

[Production of Intermediate Transfer Belts 12, 13]

There was prepared a coating solution for elastic layer formation having no change except that the amount of acrylonitrile-butadiene rubber 1 to be added to the coating solution for elastic layer formation used when intermediate transfer belt 11 was produced was changed to 90 parts by weight; the amount of chloroprene rubber to be added was changed to 9 parts by weight; and 10 parts by weight of commercially available polycarbonate having improved solvent solubility (Iupizeta (registered trademark); manufactured by Mitsubishi Gas Chemical Company, Inc.) was added. An elastic layer was formed on a substrate layer in the same procedure as that of intermediate transfer belt 11. Furthermore, a surface layer having the same conditions was formed to produce intermediate transfer belt 12.

A coating solution for elastic layer formation having no change except that 10 parts by weight of a commercially available moisture-curable urethane resin (Burnock (registered trademark); manufactured by DIC Corporation) was used for the coating solution for elastic layer formation used when intermediate transfer belt 12 was produced, in place of polycarbonate having improved solvent solubility, to form an elastic layer on a substrate layer in the same procedure as that of intermediate transfer belt 12. A surface layer was formed under the same conditions to produce intermediate transfer belt 13.

[Production of Intermediate Transfer Belts 14, 15]

When the surface layer was formed in the production of intermediate transfer belt 1, the surface layer was formed such that the dry film thickness of the surface layer was 10 μm, to produce intermediate transfer belt 14, and the surface layer was formed such that the dry film thickness of the surface layer was 12 μm, to produce intermediate transfer belt 15. Specifically, a coating film having the dry film thickness was formed in a state where the number of nozzle, the coating solution supply amount, and the oxygen flow rate in the spray coating conditions were changed. Furthermore, intermediate transfer belts 14, 15 were produced in a state where the irradiation time of the high-pressure mercury lamp was changed.

The electrostatic capacity per unit area and the standard deviation of electrostatic capacity were measured for each intermediate transfer belt using Coating Thickness Scanning System TSS20 (manufactured by Lasertec Corporation). The volume resistivity of each intermediate transfer belt was measured using a high resistivity meter (manufactured by Mitsubishi Chemical Analytech Co., Ltd.). Furthermore, the surface resistivity of each intermediate transfer belt was measured using Digital Super Megohmmeter (manufactured by Hioki E.E. Corporation).

Classification, intermediate transfer belt No., the type and the SP value of acrylonitrile-butadiene rubber, the type of the blend polymer, the type, the SP value and the content of the ion conductive agent, the difference (ΔSP) between the SP value of acrylonitrile-butadiene rubber and the SP value of the blend polymer, the thickness of the elastic layer, the standard deviation ($\sigma_C$) of electrostatic capacity, the electrostatic capacity (c) per unit area, the surface resistivity ($R_S$), and the volume resistivity (ρ) are illustrated in Table. 1 for each intermediate transfer belt. In Table 1, the "belt No." represents intermediate transfer belt No.; the "rubber" represents acrylonitrile-butadiene rubber; the "polymer" represents the blend polymer; and "CR" represents chloropyrene rubber.

TABLE 1

| | | Elastic layer | | | | | | | |
|---|---|---|---|---|---|---|---|---|---|
| | | Rubber composition | | | | | | | |
| | | | | | Ion conductive agent | | | | |
| | | Rubber | | | | | Content | | |
| Classification | Belt No. | Type | SP value [(J/cm$^3$)$^{1/2}$] | Polymer | Type | SP value [(J/cm$^3$)$^{1/2}$] | [parts by weight] | ΔSP [(J/cm$^3$)$^{1/2}$] | Thickness [μm] |
| Examples | 1 | 1 | 10.3 | CR | 1 | 7.3 | 20 | 3.0 | 300 |
| | 2 | 1 | 10.3 | | 1 | 7.3 | 10 | 3.0 | 200 |
| | 3 | 1 | 10.3 | | 1 | 7.3 | 30 | 3.0 | 200 |
| | 4 | 1 | 10.3 | | 1 | 7.3 | 30 | 3.0 | 300 |
| | 5 | 1 | 10.3 | | 1 | 7.3 | 30 | 3.0 | 200 |
| | 6 | 1 | 10.3 | | 1 | 7.3 | 5 | 3.0 | 200 |
| | 7 | 2 | 8.7 | | 2 | 13.5 | 20 | 4.8 | 300 |
| | 8 | 2 | 8.7 | | 2 | 13.5 | 20 | 4.8 | 200 |
| | 9 | 1 | 10.3 | | 1 | 7.3 | 40 | 3.0 | 200 |
| | 10 | 2 | 8.7 | | 2 | 13.5 | 40 | 4.8 | 200 |
| | 11 | 1 | 10.3 | | 1 | 7.3 | 30 | 3.0 | 200 |
| | 12 | 1 | 10.3 | | 1 | 7.3 | 30 | 3.0 | 200 |
| | 13 | 1 | 10.3 | | 1 | 7.3 | 30 | 3.0 | 200 |
| | 14 | 1 | 10.3 | | 1 | 7.3 | 20 | 3.0 | 300 |
| | 15 | 1 | 10.3 | | 1 | 7.3 | 20 | 3.0 | 300 |
| Comparative Examples | C1 | 3 | 8.2 | CR | 2 | 13.5 | 30 | 5.3 | 200 |
| | C2 | 1 | 10.3 | | 1 | 7.3 | 20 | 3.0 | 150 |
| | C3 | 1 | 10.3 | | 1 | 7.3 | 1 | 3.0 | 200 |
| | C4 | 1 | 10.3 | | 1 | 7.3 | 20 | 3.0 | 400 |
| | C5 | 1 | 10.3 | | 1 | 7.3 | 20 | 3.0 | 400 |

| Classification | Belt No. | σc [pF] | c [pF/cm$^2$] | Rs [Ω/□] | ρ [Ω · cm] | Remarks |
|---|---|---|---|---|---|---|
| Examples | 1 | 200 | 13.5 | $10^{12}$ | $10^{11}$ | |
| | 2 | 150 | 14.5 | $10^{13}$ | $10^{11}$ | |
| | 3 | 150 | 14.5 | $10^{11}$ | $10^{8}$ | |
| | 4 | 200 | 14.0 | $10^{11}$ | $10^{8}$ | |
| | 5 | 150 | 14.5 | $10^{11}$ | $10^{8}$ | |
| | 6 | 150 | 14.5 | $10^{13}$ | $10^{12}$ | |
| | 7 | 200 | 14.5 | $10^{12}$ | $10^{11}$ | |
| | 8 | 200 | 14.5 | $10^{12}$ | $10^{11}$ | |
| | 9 | 200 | 14.5 | $10^{10}$ | $10^{7}$ | |
| | 10 | 200 | 14.5 | $10^{10}$ | $10^{7}$ | |
| | 11 | 200 | 14.5 | $10^{11}$ | $10^{8}$ | |
| | 12 | 200 | 14.5 | $10^{12}$ | $10^{9}$ | Polycarbonate-containing elastic layer |
| | 13 | 200 | 14.5 | $10^{12}$ | $10^{9}$ | Polyurethane resin-containing elastic layer |
| | 14 | 200 | 13.5 | $10^{12}$ | $10^{12}$ | Thickness of surface layer: 10 μm |
| | 15 | 200 | 13.5 | $10^{12}$ | $10^{12}$ | Thickness of surface layer: 12 μm |
| Comparative Examples | C1 | 250 | 14.5 | $10^{11}$ | $10^{8}$ | |
| | C2 | 150 | 13.5 | $10^{12}$ | $10^{11}$ | |
| | C3 | 150 | 15.5 | $10^{14}$ | $10^{13}$ | |
| | C4 | 250 | 13.0 | $10^{12}$ | $10^{11}$ | |
| | C5 | 220 | 13.0 | $10^{12}$ | $10^{11}$ | |

[Evaluation]

(1) Transfer Property with Respect to Unevenness Paper

Each of the produced intermediate transfer belts was mounted on a full color copier (bizhub PRESS C1100: manufactured by Konica Minolta, Inc., "bizhub" is a registered trademark of this company). Gradation patterns obtained by dividing 255 gradations of RGB formed by colors of YMCK into ten levels were printed on embossed paper (Leathac 66, weighing: 302 g, manufactured by Tokusyu Tokai Paper Co. Ltd, "Leathac" is a registered trademark of this company) under an environment of 20° C. and 50% RH. Next, the transfer state of the toner was observed in the convex part of the embossed paper. The transfer property of each intermediate transfer belt with respect to unevenness paper was evaluated based on the following evaluation criteria. At this time, portions of gradations 0 to 124 are also referred to as a halftone part, and portions of gradations 125 to 255 are also referred to as a solid part. Cases where the evaluation ratings were rank 3 or more were determined as passing.

(Evaluation Criteria)

Rank 5: Transfer failures were not observed in a toner stacking part and a toner single layer part.

Rank 4: Transfer failures were observed in a toner stacking part, but transfer failures were not observed in a toner single layer part.

Rank 3: Transfer failures were observed in a toner stacking part and a toner single layer part (halftone part), but transfer failures were not observed in the toner single layer part (solid part).

Rank 2: Transfer failures were observed in a toner stacking part and a toner single layer part.

Rank 1: A toner was not transferred at all in a recessed part of embossed paper, and the plane of the paper was exposed to the surface.

(2) Convex Part Roughness with Respect to Unevenness Paper

Each of the produced intermediate transfer belts was mounted on the full color copier. Gradation patterns obtained by dividing 255 gradations of RGB formed by colors of YMCK into ten levels were printed on embossed paper (Leathac 66, weighing: 151 g, manufactured by Tokusyu Tokai Paper Co. Ltd, "Leathac" is a registered trademark of this company) under an environment of 40° C. and 80% RH. Next, the unevenness in image density in the toner was observed in the convex part of the embossed paper. The convex part roughness of each intermediate transfer belt with respect to unevenness paper was evaluated based on the following evaluation criteria. At this time, portions of gradations 0 to 59 are also referred to as a low concentration part; portions of gradations 60 to 124 are also referred to as a halftone part; and portions of gradations 125 to 255 are also referred to as a solid part. Cases where the evaluation ratings were rank 3 or more were determined as passing.

(Evaluation Criteria)

Rank 5: Unevenness in image density was not observed in colors of YMCK.

Rank 4: Unevenness in image density was observed in a low concentration part of black (K).

Rank 3: Unevenness in image density was observed in a halftone part of black (K).

Rank 2: Unevenness in image density was observed in a solid part of black (K).

Rank 1: Unevenness in image density was observed in any color of YMC.

(3) Durability

Each intermediate transfer belt produced in a state where a current of 100 μA was always made to flow in a closed space and tension of 10 N was added was rotated for 300 hours. Next, the state of the surface of the intermediate transfer belt was visually observed. The durability of each intermediate transfer belt was evaluated based on the following evaluation Criteria. Cases where the evaluation ratings were "A" and "B" were determined as passing.

(Evaluation Criteria)

A: Cracks having a length of less than 3 μm were observed.

B: 5 or less cracks having a length of 3 μm or more were observed.

C: 5 or more cracks having a length of 3 μm or more were observed.

Evaluation ratings of classification, intermediate transfer belt No., transfer property with respect to unevenness paper, convex part roughness with respect to unevenness paper, and durability for each intermediate transfer belt are Illustrated in Table 2. In Table 2, the "belt No." represents intermediate transfer belt No.

TABLE 2

| | Belt No. | transfer property | convex part roughness | Durability |
|---|---|---|---|---|
| Examples | 1 | 5 | 4 | A |
| | 2 | 3 | 4 | A |
| | 3 | 4 | 3 | A |
| | 4 | 4 | 3 | A |
| | 5 | 3 | 3 | A |
| | 6 | 3 | 4 | A |
| | 7 | 4 | 3 | A |
| | 8 | 3 | 3 | A |
| | 9 | 3 | 3 | A |
| | 10 | 3 | 3 | A |
| | 11 | 3 | 3 | B |
| | 12 | 4 | 3 | A |
| | 13 | 3 | 4 | A |
| | 14 | 5 | 4 | A |
| | 15 | 4 | 4 | B |
| Comparative Examples | C1 | 3 | 2 | A |
| | C2 | 2 | 3 | A |
| | C3 | 2 | 3 | A |
| | C4 | 4 | 2 | A |
| | C5 | 3 | 2 | C |

As clear from Table 2, intermediate transfer belts 1 to 11 had excellent durability and transfer property, and suppressed the occurrence of convex part roughness. This is considered to be because intermediate transfer belts 1 to 11 include the elastic layer having a thickness of 200 to 300 μm, and have an electrostatic capacity per unit area of 13.5 to 14.5 pF/cm$^2$, the electrostatic capacity having a standard deviation of 200 pF or less.

On the other hand, as clear from Table 2, intermediate transfer belts C1 and C4 caused convex part roughness. This is considered to be because intermediate transfer belt C1 has electrostatic capacity having a standard deviation of more than 200 pF. Also, this is considered to be because intermediate transfer belt C4 has the elastic layer having a thickness of more than 300 μm, and has an electrostatic capacity per unit area of less than 13.5 pF/cm$^2$, the electrostatic capacity having a standard deviation of more than 200 pF.

Intermediate transfer belts C2 and C3 had insufficient transfer property. This is considered to be because intermediate transfer belt C2 includes the elastic layer having a thickness of less than 200 μm. This is considered to be because intermediate transfer belt C3 has an electrostatic capacity per unit area of more than 14.5 pF/cm$^2$.

Intermediate transfer belt C5 had insufficient durability and caused discharge noise. This is considered to be because intermediate transfer belt C5 includes the elastic layer having a thickness of more than 300 μm and has an electrostatic capacity per unit area of less than 13.5 pF/cm$^2$, the electrostatic capacity having a standard deviation of more than 200 pF.

Furthermore, intermediate transfer belts 12, 13 have higher durability than that of intermediate transfer belt 11. This is considered to be because intermediate transfer belts 12, 13 contain the polycarbonate resin and the polyurethane resin to reduce the contents of acrylonitrile-butadiene rubber or chloroprene rubber, and therefore, the density of the unsaturated double bond in diene crosslinked rubber is decreased to provide a resin resistant to ozone degradation.

Although embodiments of the present invention have been described and illustrated in detail, it is clearly understood that the same is by way of illustration and example only and not limitation, the scope of the present invention should be interpreted by terms of the appended claims.

INDUSTRIAL APPLICABILITY

The present invention can provide an intermediate transfer belt that has excellent durability and transfer property to unevenness paper and can suppress the occurrence of convex part roughness (discharge noise), and can provide an image forming apparatus not causing any transfer failures over a long period.

What is claimed is:

1. An endless intermediate transfer belt comprising:

an elastic layer having a thickness of 200 to 300 μm; and a surface layer disposed on the elastic layer, wherein the endless intermediate transfer belt has an electrostatic capacity per unit area of 13.5 to 14.5 $pF/cm^2$, the electrostatic capacity having a standard deviation of 200 pF or less.

2. The intermediate transfer belt according to claim 1, wherein the intermediate transfer belt has a volume resistivity of $10^8$ to $10^{12}$ Ω·cm and a surface resistivity of $10^{11}$ to $10^{13}$ Ω/□.

3. The intermediate transfer belt according to claim 1, wherein the elastic layer is configured by a rubber composition containing diene crosslinked rubber and a non-diene polymer.

4. The intermediate transfer belt according to claim 1, wherein the elastic layer is configured by a rubber composition containing diene crosslinked rubber and an ion conductive agent, and a difference between a solubility parameter of the diene crosslinked rubber and a solubility parameter of the ion conductive agent is less than 6.15 $(J/cm^3)^{1/2}$.

5. The intermediate transfer belt according to claim 1, wherein the surface layer has a thickness of 10 μm or less.

6. An electrophotographic image forming apparatus comprising an intermediate transfer belt for transferring a toner image formed on a photoconductor to a recording medium, wherein the intermediate transfer belt is the intermediate transfer belt according to claim 1.

* * * * *